United States Patent [19]

Myklebust

[11] 4,223,709

[45] Sep. 23, 1980

[54] REINFORCED FLEXIBLE CONTAINER

[75] Inventor: Eirik Myklebust, Porsgrunn, Norway

[73] Assignee: Norsk Hydro A/S, Oslo, Norway

[21] Appl. No.: 39,381

[22] Filed: May 15, 1979

[30] Foreign Application Priority Data

Jun. 1, 1978 [NO] Norway ..... 781905

[51] Int. Cl.[3] ..... B65D 33/02

[52] U.S. Cl. ..... 150/1; 229/55

[58] Field of Search ..... 150/0.5, 1, 48, 51, 150/12; 229/55

[56] References Cited

U.S. PATENT DOCUMENTS

| | | | |
|---|---|---|---|
| 353,692 | 12/1886 | Magee | 229/55 X |
| 526,566 | 9/1894 | Field | 150/12 X |
| 1,677,583 | 7/1928 | Cromwell | 150/48 |
| 2,437,184 | 3/1948 | Brady | 150/1 |
| 2,934,122 | 4/1960 | Lindsey | 150/1 |
| 3,554,434 | 1/1971 | Anderson | 229/55 |
| 4,136,723 | 1/1979 | Skaadel | 150/1 |

FOREIGN PATENT DOCUMENTS

| | | |
|---|---|---|
| 1431582 | 4/1976 | United Kingdom . |
| 1475019 | 6/1977 | United Kingdom . |

*Primary Examiner*—Donald F. Norton

*Attorney, Agent, or Firm*—Wenderoth, Lind & Ponack

[57] ABSTRACT

A reinforced flexible container unit includes a flexible container having an upper section with lifting loops, a filling opening, a container bottom, and a central section formed by side walls extending from the container bottom to the upper section. The central section has a height portion extending upwardly from the container bottom and adapted to be contacted by bulk material when the container is filled with such bulk material. A reinforcing belt or belts are positioned to extend around the entire circumference of the central section of the container at least at a lower portion thereof adjacent the container bottom. The belt or belts have an open lower end and do not cover or enclose the container bottom. The belt or belts have a total width of from one-third of the height portion of the central section of the container equal to the height of such height section.

5 Claims, 2 Drawing Figures

REINFORCED FLEXIBLE CONTAINER

BACKGROUND OF THE INVENTION

The present invention relates to a reinforced flexible container for transportation and storage of bulk material. The container comprises a conventional flexible container which can be made from woven textile fibers, laminated plastics or textile coated with plastic or the like. It comprises a bottom section, a central section and an upper section with lifting loops, and it can also be equipped with an inner sack of impervious material. The lifting loops can be integral parts of the container itself, but may also comprise separate loops or lifting straps secured to the container.

Several types of such containers for transportation of bulk material are used today. Some of these known containers are used only once, while others can be used several times. Among such known flexible containers are those described in British Pat. No. 1,431,582, published Apr. 7, 1976; and in British Pat. No. 1,475,019, published June 1, 1977, U.S. Pat. No. 4,136,713.

The container according to the above U.S. patent is preferably equipped with an inner sack of impervious material, and preferably the upper section of the container comprises integrated lifting loops and a central filling opening. The special feature of this container is that its bottom section consists of at least two pairs of equally wide flaps which are direct extensions of the container walls, and that such flaps are joined at their lower edges such that the joints thereby formed cross each other at one point. This bottom construction has by dynamic testing been found to endure greater strains than the bottom construction according to the above mentioned British Pat. No. 1,475,019.

For certain applications however, conventional flexible containers do not meet the requirements regarding container strength. For transportation of dangerous material like ammonium nitrate for instance, it is required that the container shall endure a specified drop against a plain floor, etc. without rupturing. By example, Verkehr der Bundesrepublik Deutschland, i.e. the authorities of the German Federal Republic, require that flexible containers having a volume of 250–1250 liters shall endure a drop of 1.2 meter when they are filled with pulverent, dangerous materials. References made to "Amtsblatt der Bundesministers f,uml/u/ r Verkehr der Bundesrepublik Deutschland", No. 6, page 254–259, of Mar. 31, 1976 volume 30, published in Bonn, Germany. In this application dangerous material means that classified as such in packaging group 3 by the Intergovernmental Maritime Consultative Organization (IMCO).

The disadvantage of the known flexible containers is that they burst just above the bottom when dropped, in filled condition, against a floor etc. Tests have shown that most of them burst already when the drop height is only 0.3 meter.

SUMMARY OF THE INVENTION

The main object of the present invention is to provide flexible containers which may be employed for transportation and storage of dangerous material. Another object is to provide such container by just reinforcing known flexible containers without substantially changing their basic construction or method of manufacture.

Reinforcing known containers by increasing the weaving density or the thickness of the fabric has proved to be expensive for making containers that could endure a drop height of 1.2 meter. In addition to increasing weaving density and/or thickness of the fibres, this method also requires that the seams be reinforced.

The inventors have developed a simple method of obtaining sufficiently strong flexible containers without altering the basic construction of known containers.

The special feature of the invention is that a flexible container is equipped with at least one belt around its central section and that the belt or belts have a total width which maybe as much as the height of the bulk material in the filled container. Preferably such belt width corresponds to $\frac{1}{3}$–$\frac{2}{3}$ of the height of the bulk material of the filled container, and the belt is than placed around the lower part of the container.

The belt or belts can be made from the same material as the container itself, and preferably the belt is formed of round woven textile material. The belt can, however, also be made by joining together a piece of woven textile material.

The belt can also consist of a wide strap with tightening means such that the strap is secured around the container subsequent to the filling of the container.

The invention also includes a flexible container equipped with several narrow belts. The same reinforcement is then obtained with a total width of the belts somewhat less than the width necessary with a single belt. The application of several belts is, however, in most cases more expensive and labour consuming.

The most preferred performance of the invention is to place a round woven belt around the container before filling. During the filling operation the container walls will be pressed against the belt and keep it in the right position. Optionally, the belt can be secured flexibly to the container by means of, for instance, tape or threads through the belt and the container wall.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
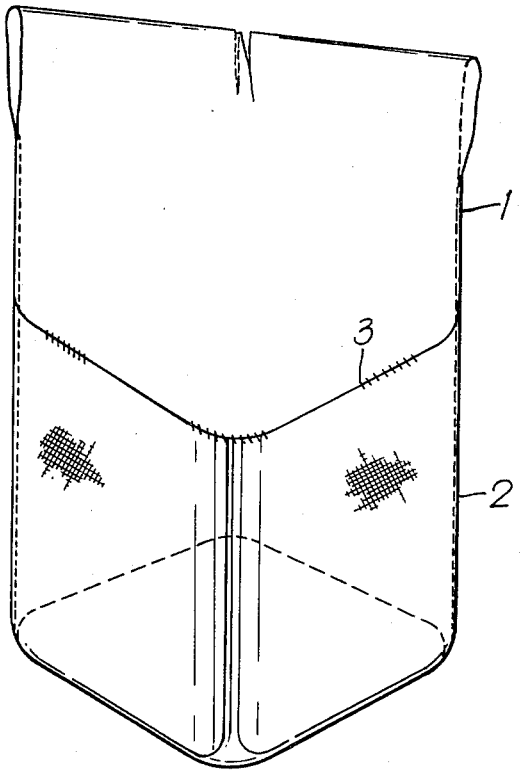
FIG. 1 is a schematic perspective view of a reinforced flexible container unit according to one embodiment of the present invention.
Figure 2:
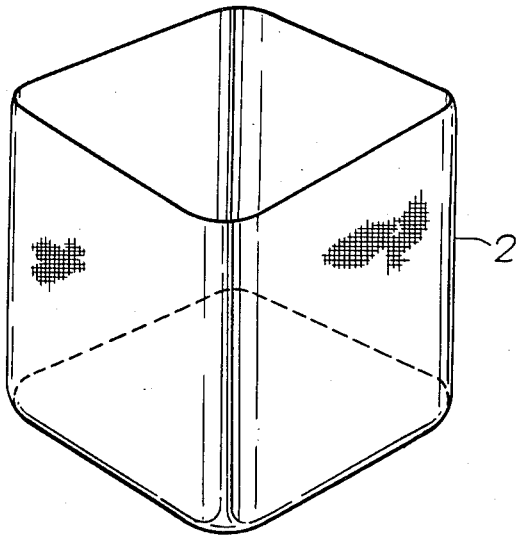
FIG. 2 is a schematic perspective view of a tubular woven reinforcing belt employable in the unit of the present invention.

One example of a reinforced flexible container according to the invention is schematicly shown in FIG. 1. Around the container 1 there is a belt 2. Threads 3 for securing the belt 2 are shown, even though they are not necessary. FIG. 2 shows a round of tubular woven belt 2.

The most essential advantage of the invention is that it makes it possible in a very simple way to reinforce conventional flexible containers when that is necessary. This means that flexible containers can be manufactured for different purposes by the same method and equipment and only those containers that must endure drop strain have to be equipped with a belt and this is preferably done immediately before filling the container. Accordingly, a reinforced flexible container is attained without altering the basic construction of the container itself.

Another advantage of the invention is that it can be applied to several types of flexible containers. A further advantage of the invention is that the belt can be used for marking purposes, as informative label, etc.

EXAMPLE

Flexible containers according to U.S. Pat. No. 4,136,723 were filled with 800 kilos of bulk material (NPK-fertilizer prills) and exposed to varying drop tests. Three such containers were not equipped with belts, while three such containers were equipped with belts of woven polypropylene having the same weaving density and fibre thickness as the container itself. A circular belt was made from a piece of woven polypropylene joined together by zigzag seams. Such belts are somewhat weaker than round woven belts made from the same material. The width of the belts were $\frac{2}{3}$ of the height of the bulk material in the filled containers. The belts were thread around the containers immediately before filling.

The following table shows the test results:

TABLE

| | Container without belt | | | Container with belt | | | |
|---|---|---|---|---|---|---|---|
| Drop height | 1 | 2 | 3 | 4 | 5 | 6 | |
| 0.10 m | | | | | | | |
| 0.20 | ok | ok | ok | | | | |
| 0.30 | R | R | R | | | | |
| 0.40 | | | | | | | |
| 0.50 | | | | ok | | ok | |
| 0.60 | | | | | | | |
| 0.70 | | | | | | | |
| 0.80 | | | | ok | ok | ok | |
| 0.90 | | | | | | | |
| 1.00 | | | | | | | |
| 1.10 | | | | | | | |
| 1.20 | | | | ok | ok,ok[x] | ok | German Limit |
| 1.30 | | | | | | | |
| 1.40 | | | | | | | |
| 1.50 | | | | ok | ok | ok | |
| 1.60 | | | | | | R | |

Each container without a belt burst at the second drop which was 0.3 meter high. Two of the reinforced containers were exposed to four drop tests and were still completely intact, marked ok in the table. One of the reinforced containers was dropped five times and burst at the fifth drop which was 1.6 meter high, marked R in the table.

It was proved during the tests that by equipping a conventional flexible container with a belt, it was reinforced such that it could endure for instance several drops of more than 1.2 meter, contrary to a conventional container without the best which burst at a drop of 0.3 meter. The containers first burst at the side seams just above the bottom of the containers. If stronger belts than those in the above example are used, the reinforced containers will endure drops of even more than 1.6 meter.

I claim:

1. A reinforced flexible container unit for transportion and storage of bulk material, said unit comprising: a flexible container including an upper section having lifting loops and a filling opening, a container bottom, and a central section formed by side walls extending from said container bottom to said upper section, said central section having a height portion extending upwardly from said container bottom and adapted to be contacted by bulk material when said container is filled with such bulk material; and reinforcing means for reinforcing said container against rupture caused by strain imparted to said container when filled with bulk material upon dropping of such filled container, said reinforcing means comprising at least one belt formed of a material capable of resisting said strain, said belt being positioned to extend around the entire circumference of said central section of said container at least at a lower portion thereof adjacent said container bottom, said belt having an open lower end, said belt not covering or enclosing said container bottom, and the total width of said belt being from one-third the height of said height portion of said central section of said container to equal to said height of said height portion.

2. A reinforced flexible container unit as claimed in claim 1, further comprising an inner sack of impervious material positioned within said flexible container.

3. A reinforced flexible container unit as claimed in claim 1, wherein said at least one belt comprises a tubular woven belt of textile material, said woven belt being attached to said flexible container and having a width of from one-third to two-thirds of said height of said height portion.

4. A reinforced flexible container unit as claimed in claim 3, wherein said woven belt is formed of the same material and has the same weaving density and fiber thickness as said flexible container.

5. A reinforced flexible container unit as claimed in claims 1 or 3, wherein said belt is secured to said flexible container by means of tape or threads.

* * * * *